United States Patent [19]

Hagihara et al.

[11] Patent Number: 4,579,328

[45] Date of Patent: Apr. 1, 1986

[54] COPY PAPER FEEDING DEVICE FOR ELECTROPHOTOGRAPHIC COPYING MACHINE

[75] Inventors: Hideaki Hagihara, Moriguchi; Mitsuru Mizutani, Nishinomiya, both of Japan

[73] Assignee: Sharp Kabushiki Kaisha, Osaka, Japan

[21] Appl. No.: 570,092

[22] Filed: Jan. 12, 1984

[30] Foreign Application Priority Data

Jan. 19, 1983 [JP] Japan ..... 58-6379[U]

[51] Int. Cl.[4] ..... B65H 3/06

[52] U.S. Cl. ..... 271/9; 271/22; 271/119; 271/127

[58] Field of Search ..... 271/9, 119, 22, 127

[56] References Cited

U.S. PATENT DOCUMENTS 4,429,863 2/1984 Itoh ..... 271/9

4,438,915 3/1984 Akamatsu ..... 271/9

4,449,705 5/1984 Shibuya ..... 271/9

*Primary Examiner*—Richard A. Schacher

*Attorney, Agent, or Firm*—Birch, Stewart, Kolasch & Birch

[57] ABSTRACT

An electrophotographic copying machine comprises a copy paper feeding device for serving for an automatic paper feeding mode and a manual paper feeding mode. The automatic paper feeding mode is such that a great number of papers as stored in the device are automatically inserted into the copying machine. The manual paper feeding mode is such that a manually inserted paper different from the papers stored in the device is inserted into the copying machine. A cover of the device is slided for selecting either the automatic paper feeding mode or the manual paper feeding mode. Responsive to the slide position of the cover, a stopper is seesawed for opening or closing an opening through which the manually inserted paper is to be transported.

6 Claims, 3 Drawing Figures

COPY PAPER FEEDING DEVICE FOR ELECTROPHOTOGRAPHIC COPYING MACHINE

BACKGROUND OF THE INVENTION

The present invention relates to an electrophotographic copying machine and, more particularly, to a copy paper feeding device.

An electrophotographic copying machine produces an electrostatic latent image corresponding to a pattern image on a document such as a manuscript or book to be copied. Toner particles are electrically adhered to the latent image, so that the latent image becomes visible to form a toner image. The toner image is transferred onto a copy paper via a transference charger.

Normally, the copy paper is automatically fed by an automatic paper feeder which stores a great number of copy papers. It may be preferable to copy onto a paper different from the papers stored in the automatic paper feeder which will then be used to receive the toner image thereon. For this purpose, any desired paper is inserted manually while operating a manual paper feeding device.

Conventionally, the manual paper feeding device is such that a particular opening through which different paper is to be inserted separately provided from the automatic paper feeder having a paper cassette or tray. Thus, a special opening is needed to operate the manual paper feeding system, which prevents the copying machine from being compact and simple. Therefore, it is desired to provide an improved paper feeding device.

SUMMARY OF THE INVENTION

Accordingly, it is an object of the present invention to provide an improved paper feeding device for feeding papers, automatically and manually.

It is another object of the present invention to provide an improved automatic paper feeding device for serving as part of a manual paper feeding device.

It is a further object of the present invention to provide an improved automatic paper feeding device for preventing a manual paper feeding mode from being carried out while the automatic paper feeding mode is carried out.

Briefly described, in accordance with the present invention, an electrophotographic copying machine comprises a paper feeding device serving as an automatic paper feeder and a manual paper feeder. The paper feeding device includes a cover positioned at its upper portion. To enable an automatic paper feeding mode, the paper feeding device functions to feed a great number of papers as stored therein by pulling out the cover from the copying machine. To enable a manual paper feeding mode, the cover of the paper feeding device is able to transport a manually inserted paper by pushing in the cover back into the copying machine. In synchronization with the pushing-in and the pulling-out of the cover, if the automatic paper feeding mode is selected, a stopper engages with the cover so that the manually inserted paper is interrupted. Responsive to slidably positioning the cover, the stopper is pivotally rotated for opening and closing an opening through which the manually inserted paper is to be inserted.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

Figure 1:
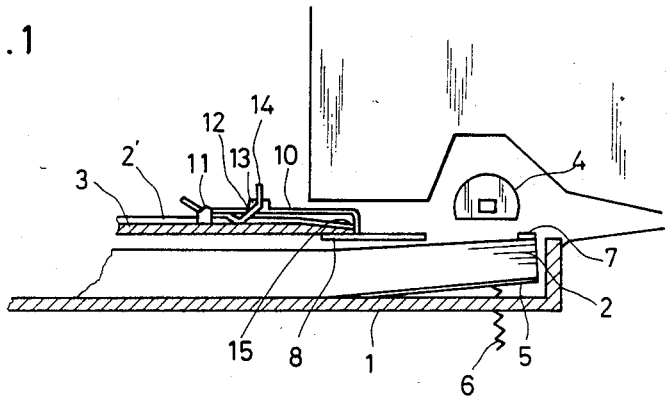
FIG. 1 is a cross-sectional view of a paper feeding device according to the present invention, showing an automatic paper feeding mode.
Figure 2:
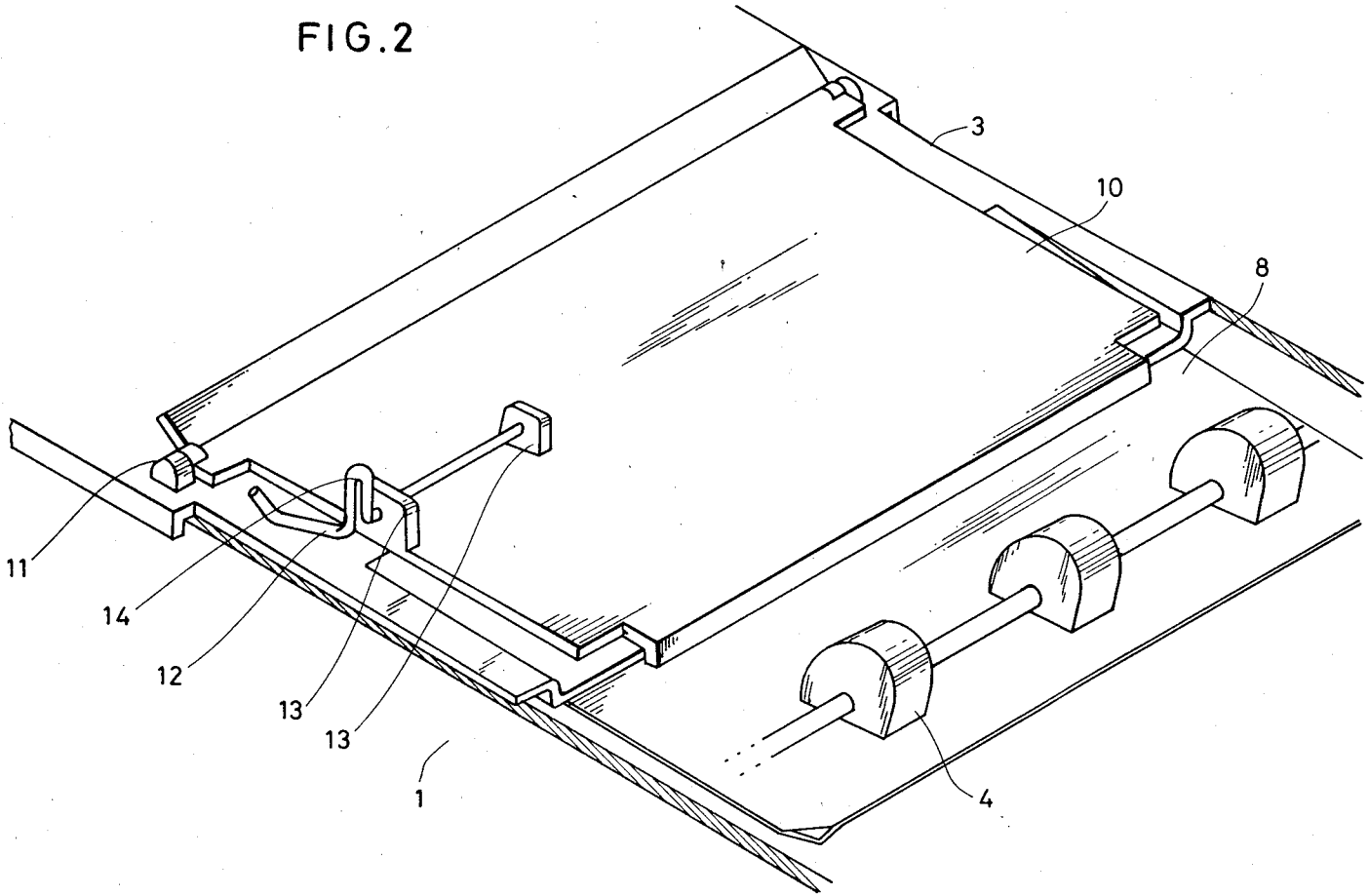
FIG. 2 is a perspective view of the paper feeding device of FIG. 1.

FIG. 1 shows a cross-sectional view of a paper feeding device of the present invention in an automatic paper feeding mode. FIG. 2 shows a perspective view of this paper feeding device.

Referring now to FIGS. 1 and 2, the paper feeding device 1 comprises a paper cassette 1 for storing a great number of copy papers 2, a cover 3, some paper pick-up rollers 4, a bottom plate 5, a spring 6, a paper downing claw 7, a paper guide 8, a stopper 10, a stopper support member 11, a stopper release lever 12, and a lever support member 13.

The cassette 1 is detachably attached to a paper insertion opening of an electrophotographic copying machine. The plurality of paper pick-up rollers 4 are positioned to confront the paper stack in the cassette 1 when the cassette 1 is fully inserted into the machine. The plurality of pick-up rollers 4 are rotated according to paper feeding signals from a control circuit of the copying machine to pick up single copy paper. The cover 3 is disposed at an upper position of the cassette 1 for carrying the stopper 10, the stopper support member 11, the lever 12, and the lever support member 13. The cover 3 covers the papers 2 within the cassette 1. The cover 3 is slidable and carries the stopper 10, the stopper support member 11, the lever 12, and the lever support member 13. The base plate 5 supports the papers 2 while the base plate 5 is biased by the spring 6 to lift the papers up to a paper pick-up level. The claw 7 is provided for preventing the top paper from floating upward and assuring that the papers are positioned at an appropriate level.

According to the present invention, on the cover 3, means is provided for allowing a manually inserted paper 2' to be transported and for preventing the manually inserted paper 2' from being inserted. The means includes the stopper 10 having a bent edge for interrupting the manually inserted paper 2' when the edge of the stopper 10 is engaged with the edge of the cover 3. The other side of the stopper 10 is pivotally supported by the stopper support member 11 fixed on the cover 3, so that the stopper 3 can be rotated.

The paper guide 8 is disposed on the bottom surface and front end of the cover 3. The guide 8 is made of a thin stainless plate to somewhat cover the papers 2. When the paper pick-up rollers 4 are rotated, the rollers 4 come in contact with the manually inserted paper 2' but are prevented from being in contact with the papers 2 in the cassette 1 due to the paper guide 8. The reason why the guide 8 is made of stainless steel so that the rollers 4 will contact with the manually inserted paper 2' with an appropriate pressure with the help of deflection by the guide 8.

The stopper release lever 12 is supported by the lever support member 13, so that the shaft of the lever 12 can be rotated. The end of the lever 12 rests on the cover 3. When the cover 3 is inserted into the copying machine with the stopper release lever 12, an arm 14 of the lever 12 collides with a front edge of the paper opening in the copying machine. The bent edge of the stopper 10 engages with the front edge of the cover 3, as stated above.

There is a clearance between the stopper 10 and the cover 3 where they are joined by the stopper support member 11 for inserting the paper 2' as well as a manual paper insertion opening 15.

Figure 3:
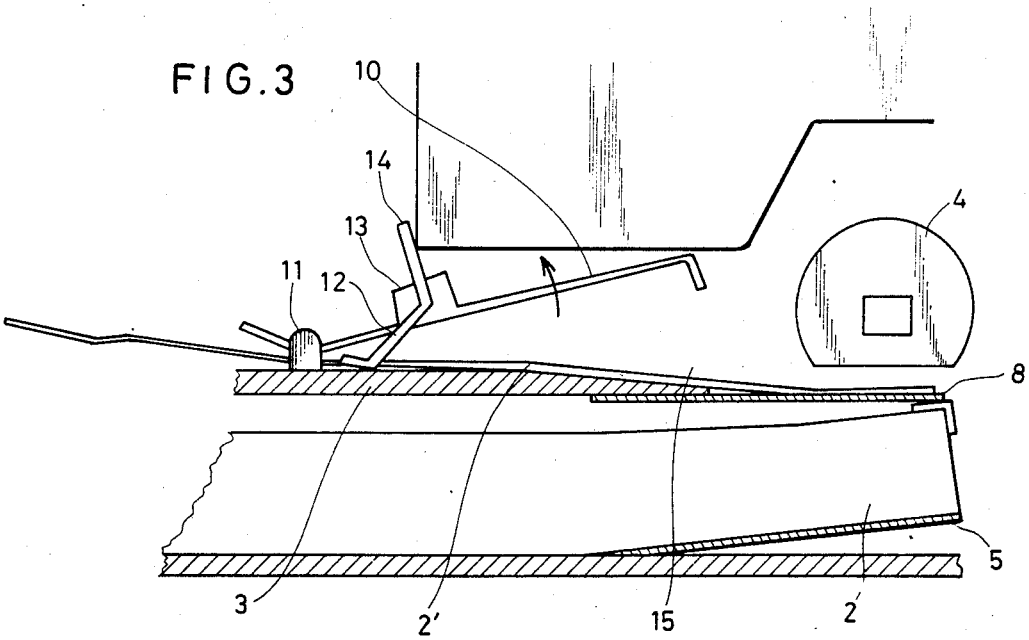
FIG. 3 is a cross-sectional view of the paper feeding device, showing a manual paper feeding mode.

FIG. 3 shows a manual paper feeding mode in the paper feeding device of FIGS. 1 and 2.

To enable the automatic paper feeding mode, as FIG. 1 shows, the cover 3 is pulled out from the paper insertion opening by sliding it away from the paper pick-up rollers 4, so that the guide 8 is positioned well away from the rollers 4. Therefore, the paper pick-up rollers 4 confront the papers 2 stored within the cassette 1 to pick up the papers 2 in the automatic paper feeding mode. Even if the paper 2' is manually inserted into the clearance at the inside of the stopper support member 11 between the stopper 10 and the cover 3, the paper 2' is interrupted by the front edge of the stopper 10 engaged with the front edge of the cover 3 as shown in FIG. 1.

On the contrary, to enable the manual paper feeding mode, as FIG. 3 shows, the cover 3 pushed into the paper insertion opening of the copying machine by sliding it forward toward the paper pick-up rollers 4. Since the cover 3 carries the stopper 10, the stopper support member 11, and the lever support member 13, they are also pushed into the copying machine. With this insertion, the arm 14 of the stopper release lever 12 collides with the front edge of the paper insertion opening of the copying machine, so that the stopper 10 is pivoted counterclockwise in FIG. 3, because the arm 12 is lifted around the fulcrum which is the contact point between the arm 12 and the cover 3. An opening 15 for the manual paper feeding mode opens at the inside of the stopper 10 because the engagement between the stopper 10 and the cover 3 is released. Simultaneously, the guide 8 fully covers the papers 2 within the cassette 1, so that the guide 8 confronts the paper pick-up rollers 4 to shade the papers 2. Under the circumstances, the paper 2' is manually inserted to confront the paper pick-up rollers 4 through the opening 15, so that the paper 2' can be inserted into the copying machine by the rollers 4.

To enable the automatic paper feeding mode again, the cover 3 is pulled out from the copy paper insertion opening, so that the guide 8 is far away from the paper pick-up rollers 4. Here, because the cover 3 carries the lever 12 with the arm 14, the collision between the arm 14 of the lever 12 and the front edge of the paper insertion opening of the copying machine is released, so that the stopper 10 is rotated clockwise to close the manual paper insertion opening 15. Even if the paper 2' is manually inserted, it is stopped by the stopper 10 from engaging with the front edge of the cover 3, so that the paper 2' cannot confront the paper pick-up rollers 4. Instead, the papers 2 within the cassette 1 are inserted into the copying machine according to paper feeding signals supplied from a control circuit of the copying machine.

While only certain embodiments of the present invention have been described, it will be apparent to those skilled in the art that various changes and modifications may be made therein without departing from the spirit and scope of the present invention as claimed.

What is claimed is:

1. A device for feeding at least one sheet of copy paper into an electrophotographic copying machine, said copying machine having a plurality of paper-pick-up rollers associated therewith, comprising:

paper cassette means removably engaged with said copying machine for storing a plurality of copy papers;

slidable cover means for covering said paper cassette means wherein said cover means is defined by a front edge and a back edge and is of a substantially rectangular shape;

means adapted for for receiving manually inserted copy paper at a fixed position on said slidable cover means;

said slidable cover means including a paper guide mounted beneath the front edge thereof and a stopper support member mounted on top of said slidable cover and between said front edge and back edge;

paper stopper means of a substantially rectangular shape movable from an operative to an inoperative position for stopping the manual insertion of said copy paper when said stopper means is in said operative position;

said paper stopper means being downwardly bent at the forward edge thereof and including a lever supporting member and a lever arm; and means for automatically feeding said copy paper from said paper cassette means into said copy machine responsive to the positioning of said slidable cover means and for feeding manually inserted copy paper into said copy machine responsive to the positioning of said slidable cover means.

2. The device according to claim 1, wherein said means adapted for receiving manually inserted copy paper is defined by a slot formed between said slidable cover means and said paper stopper means at said fixed position on said slidable cover means.

3. The device according to claim 1, wherein said means for automatically feeding said copy paper includes means for rotatably mounting said paper stopper means about said stopper support member such that the front edge of said slidable cover means abuts the downwardly bent front edge of said paper stopper means when said paper stopper means is in said operative position thereby preventing any further travel of paper manually inserted at said fixed position.

4. A device according to claim 1, wherein said means for feeding said manually inserted copy paper includes means for rotating said paper stopper means about said stopper support member to said inoperative position such that said paper guide means is positioned beneath said paper-pick-up rollers and an opening is formed between the downwardly bent front edge of said paper stopper means and said slidable cover means thereby allowing manually inserted paper to engage with said paper-pick-up rollers.

5. A device for feeding at least one sheet of copy paper into an electrophotographic copying machine, comprising:

paper cassette means removably engaged with said copying machine for storing a plurality of copy papers;

slidable cover means for covering said paper cassette means, said slidable cover means being movable from an automatic feeding position to a manual feeding position, said slidable cover means being capable of receiving manually inserted paper on the top thereof;

paper feeding means for feeding manually inserted paper and for feeding paper in said cassette means; and paper stopper means movable from an operative to an inoperative position for stopping manual insertion of copy paper to said paper feeding means in said operative position, said paper stopper means being responsive to the position of said slidable cover means to move said paper stopper means from said operative to said inoperative position.

6. A device according to claim 5, wherein said paper stopper means includes a paper stopper pivotally mounted to said slidable cover having a downwardly bent front end which stops manually inserted paper in the operative position and a stopper release lever which lifts said paper stopper when said slidable cover is in said manual feeding position.

* * * * *